US012426688B1

(12) United States Patent
Ren

(10) Patent No.: US 12,426,688 B1
(45) Date of Patent: Sep. 30, 2025

(54) WATCH STRAP AND WEARABLE DEVICE

(71) Applicant: Quan Ren, Guangdong (CN)

(72) Inventor: Quan Ren, Guangdong (CN)

( * ) Notice: Subject to any disclaimer, the term of this patent is extended or adjusted under 35 U.S.C. 154(b) by 0 days.

(21) Appl. No.: 19/060,646

(22) Filed: Feb. 22, 2025

(51) Int. Cl.
*A44C 5/20* (2006.01)

(52) U.S. Cl.
CPC ..... *A44C 5/2071* (2013.01)

(58) Field of Classification Search
CPC ..... A44C 5/2071; A44C 5/00; A44C 5/0053; A44C 5/185; A44C 5/20; A44C 5/246; Y10T 24/4086; Y10T 24/4782; A44B 11/04; G04B 37/1486; G04B 37/18; G04B 37/16
See application file for complete search history.

(56) References Cited

U.S. PATENT DOCUMENTS

| | | | | |
|---|---|---|---|---|
| 12,127,643 | B1 * | 10/2024 | Lallo | A44C 5/2023 |
| 2024/0008601 | A1 * | 1/2024 | Chang | A44C 5/2042 |
| 2024/0389722 | A1 * | 11/2024 | Ma | A44C 5/22 |

FOREIGN PATENT DOCUMENTS

| | | | | |
|---|---|---|---|---|
| CN | 202321490279.9 | | 4/2024 | |
| JP | 2021126165 A | * | 9/2021 | A44C 5/18 |

* cited by examiner

*Primary Examiner* — Jack W Lavinder
(74) *Attorney, Agent, or Firm* — Justin Lampel

(57) ABSTRACT

A watch strap, including a first strap body, a second strap body and a pulling strip, the first strap body comprises a first section and a second section; the second strap body, the first section, and the body of the wearable device are jointly enclosed to form a through hole. an adjusting hole is defined between the second strap body and the second section. Lengths of the first section and second section are adjusted by changing the connecting position between the second strap body and the first strap body. a first end of the pulling strip is connected to the first end of the second strap body, and a second end of the pulling strip is configured to pass through the pulling channel and connect with the second end of the second strap body. The watch strap is convenient for wearing, and is not easy for falling.

9 Claims, 5 Drawing Sheets

WATCH STRAP AND WEARABLE DEVICE

TECHNICAL FIELD

The present disclosure relates to the technical field of wearable device technology, in particular to a watch strap and a wearable device.

BACKGROUND

For the existing watch straps, when users wear the watch straps, they typically insert their fingers into the adjusting hole formed between the two strap bodies to push against one of them to assist in pre-tightening the strap. This helps avoid the movement of one strap relative to the other in the traction channel, which could cause the through hole formed by the two straps to enlarge when connecting the straps. However, once the two straps are connected and the user's fingers are released, due to the adjusting hole between the straps, when the user wears the watch strap, the pre-tightened strap will be driven to move relative to the other strap's traction channel, causing the through hole formed by the two straps to be expanded, which increases the risk of falling off during wear the watch strap and negatively impacts the user experience.

SUMMARY

The present disclosure provides a watch strap and a wearable device, to improve the convenience of wearing.

To realize the above objective, the present disclosure provides a watch strap, including: a first strap body, a second strap body and a pulling strip; a first end of the first strap body is configured to connect with a body of a wearable device, and a second end of the first strap body is defined with a pulling channel; and a first end of the second strap body is configured to connect with the body of the wearable device, and a second end of the second strap body is detachably connected to the first strap body; the first strap body includes a first section and a second section; the first section is between the body of the wearable device and a connecting position of the first strap body and the second strap body; and the second section is a remaining part of the first strap body after removing the first section; the second strap body, the first section, and the body of the wearable device are jointly enclosed to form a through hole; an adjusting hole is defined between the second strap body and the second section; lengths of the first section and second section are adjusted by changing the connecting position between the second strap body and the first strap body, thereby adjusting a size of the through hole; a first end of the pulling strip is connected to the first end of the second strap body, and a second end of the pulling strip is configured to pass through the pulling channel and connect with the second end of the second strap body; and a portion of the pulling strip is located inside the through hole, and another portion of the pulling strip is inside the adjusting hole, when in use, user inserts finger into the adjusting hole to push against the pulling strip to restrict a movement relative to the pulling channel.

Furthermore, a width of the pulling strip is smaller than a width of the second strap body, and the pulling strip is fitted on one side of the second strap body facing the through hole.

Furthermore, the first end of the pulling strip is fixed to the first end of the second strap body by sewing or adhesive bonding, and/or the second end of the pulling strip is fixed to the second end of the second strap body by sewing or adhesive bonding.

Furthermore, the pulling strip includes a first segment and a second segment connected together, the first segment is a portion of the pulling strip between the first end of the pulling strip and the pulling channel, and is located inside the through hole; the second segment is a portion of the pulling strip between the pulling channel and the second end of the pulling strip, and is located in the adjusting hole.

Furthermore, the watch strap further includes a connector, the connector is configured to detachably connect the second end of the second strap body to the first strap body.

Furthermore, the connector is a hook-and-loop structure, a magnetic clasp structure, or an elastic buckle structure.

Furthermore, the connector is a hook-and-loop structure, the connector includes a first member and second member that are bonded together or separated; the first member is arranged on the first strap body, extending along the length direction of the first strap body; and the second member is arranged at the second end of the second strap body, allowing the second member to engage with the first member at different positions, thus adjusting the lengths of the first section and second section and the size of the through hole.

Furthermore, the watch strap further includes a first and/or second connector, the first connector is configured to connect the first end of the first strap body and the body of the wearable device, and the second connector is configured to connect the first end of the second strap body and the body of the wearable device.

Furthermore, at least one of the first strap body or the second strap body is provided with a reinforcement layer.

Furthermore, the pulling channel is provided with damping glue; when the pulling strip moves within the pulling channel, the pulling strip continuously comes into contact with the damping glue.

Furthermore, the damping glue is a damping glue ring, and the second end of the first strap body is folded to enclose and fix the damping glue ring; the pulling strip is passed through the pulling channel and the damping glue ring, and the pulling strip is contacted with an inner wall of the damping glue ring.

The present disclosure also provides a wearable device, including a body of the wearable device and the watch strap mentioned above.

The present disclosure provides a watch strap. The watch strap allows the user to pull the second strap body to connect the second end of the second strap body to the first strap body in order to wear the watch strap. The user inserts their finger into the adjusting hole and push against the pulling strip to restrict its movement relative to the pulling channel, thus indirectly pre-tensioning the second strap body connected to the pulling strip. This prevents the pulling strip, which is connected to the second strap body, from moving within the pulling channel and causing the through hole formed by the second strap body, the first section, and the wearable device body to enlarge. Once the second strap body is connected to the first strap body, the effective length of the second strap body and the first section forming the through hole cannot be changed due to the restriction on both the first and second strap bodies. The user can release their finger from pushing against the pulling strip, and in this state, the size of the through hole remains fixed. This ensures that the through hole will not be expanded while the strap is being worn, effectively reducing the risk of the strap falling off during wear and providing a better user experience.

BRIEF DESCRIPTION OF THE DRAWINGS

In order to more clearly illustrate the technical solutions in the embodiments of present disclosure, a brief introduction to the accompanying drawings required in the embodiments will be provided below. It is apparent that the drawings described below are only some embodiments of present disclosure, and to those skilled in the art, other drawings may be derived from these without requiring inventive effort.

DETAILED DESCRIPTION OF THE EMBODIMENTS

Figure 1:
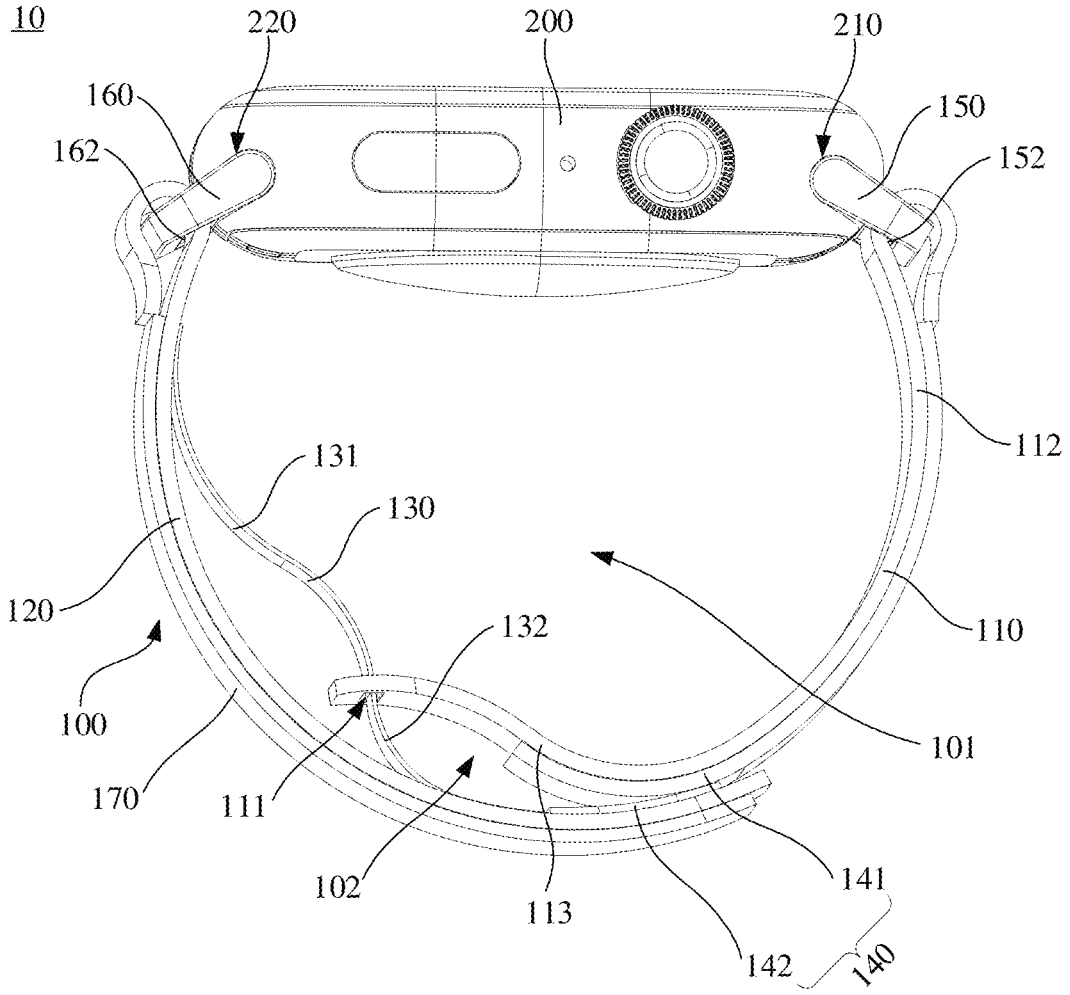
FIG. 1 is a schematic diagram showing a connection state of a wearable device and the watch strap according to an embodiment of the present disclosure.

The technical solutions in the embodiments of the present disclosure will be described clearly and completely with reference to the accompanying drawings in the embodiments of the present disclosure. Obviously, the described embodiments are only a part of the embodiments of the present disclosure rather than all of them. Based on the embodiments in the present disclosure, all other embodiments obtained by those skilled in the art without creative work shall fall within the scope of protection of the present disclosure.

It should be noted that all directional indications (such as up, down, left, right, front, back, etc.) in the embodiments of the present disclosure are used only to explain the relative position relationships, motion states, and so on between the components in a specific posture (as shown in the drawings). If the specific posture changes, the directional indications will also change accordingly.

Additionally, the descriptions involving "first," "second," etc., in the present disclosure are used only for descriptive purposes and should not be understood as indicating or implying their relative importance or the number of the technical features they refer to. Thus, the features described with "first" and "second" may explicitly or implicitly include at least one of those features. Furthermore, the term "and/or" in the entire text includes three scenarios: taking A and/or B as an example, it includes the A technical solution, the B technical solution, and the technical solution that satisfies both A and B simultaneously. Moreover, the technical solutions of different embodiments may be combined, but the combination must be based on what a person skilled in the art can implement. When the combination of technical solutions leads to contradictions or is not feasible, it should be considered that such a combination does not exist and is not within the protection scope required by the present disclosure.

Figure 2:
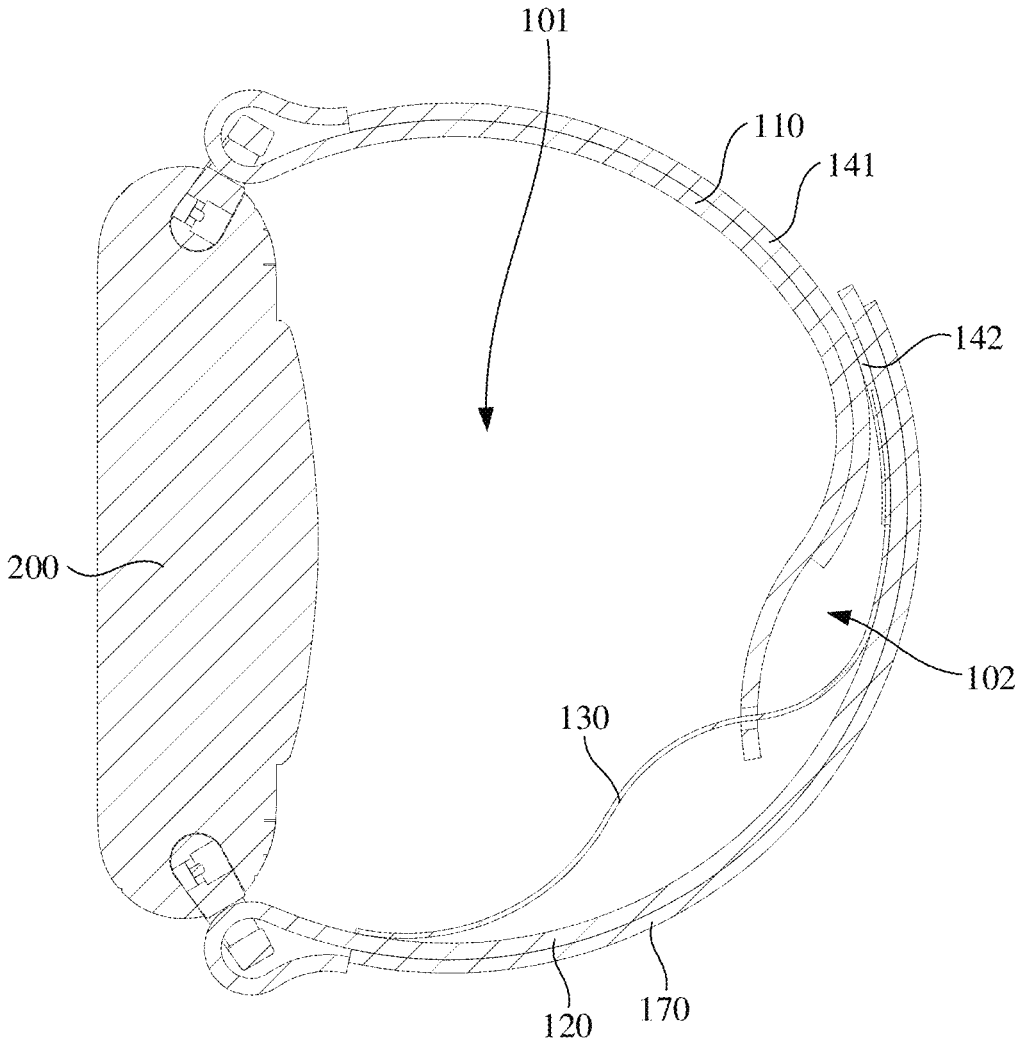
FIG. 2 is a cross-sectional view of the wearable device of FIG. 1.
Figure 3:
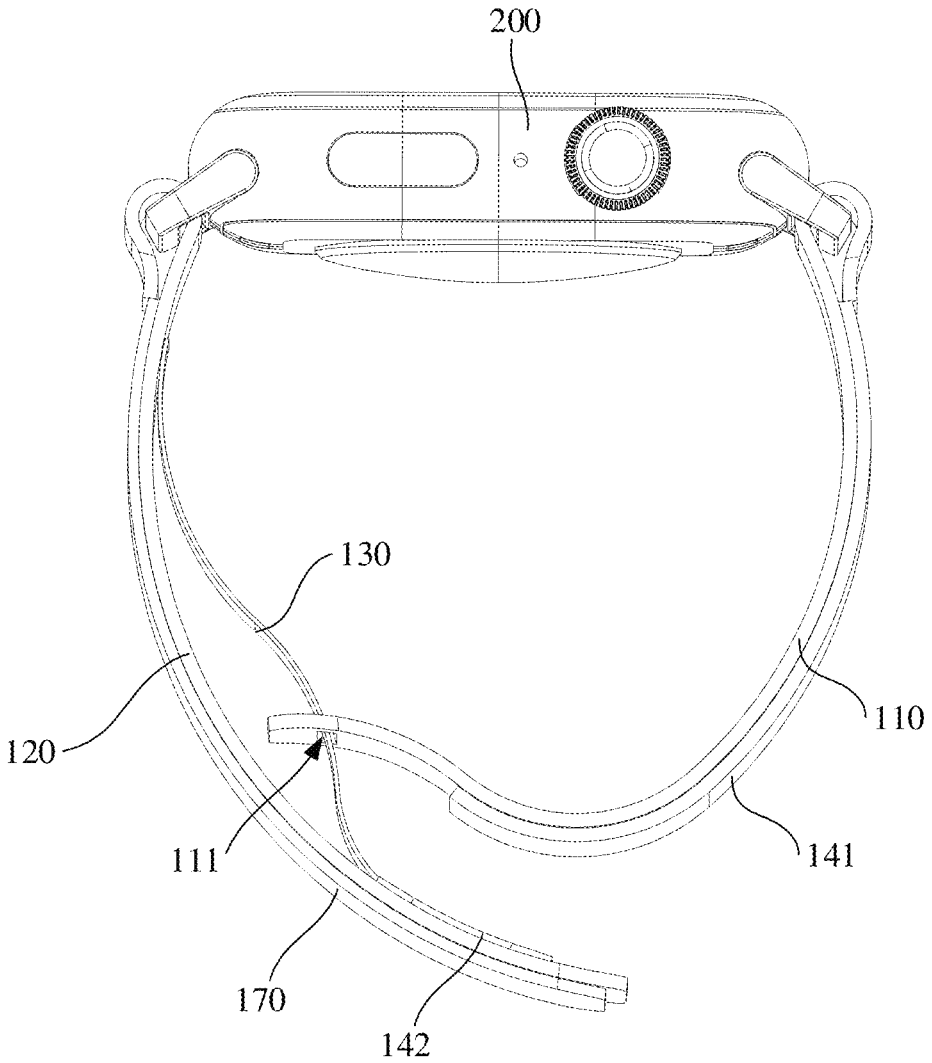
FIG. 3 is a schematic diagram showing the state of the wearable device when the first and second strap bodies are separated in FIG. 1.

As shown in FIGS. 1 to 3, the present disclosure has provided a wearable device 10, which includes a body 200 and a watch strap 100. The wearable device 10 can be a watch, and the body 200 can be a dial.

The watch strap 100 includes a first strap body 110, a second strap body 120, and a pulling strip 130. A first end of the first strap body 110 is configured to connect with the body 200, and a second end of the first strap body 110 is defined with a pulling channel 111. A first end of the second strap body 120 is configured to connect with the body 200, and a second end of the second strap body 120 is detachably connected to the first strap body 110.

The first strap body 110 includes a first section 112 and a second section 113. The first section 112 is a part of the first strap body 110 located between the body 200 and a connecting position of the first strap body 110 and the second strap body 120. The second section 113 is a remaining part of the first strap body 110 after removing the first section 112. The second strap body 120, the first section 112, and the body 200 together form a through hole 101 for wearing on the user's wrist. The second section 113 is located within the through hole 101, and an adjusting hole 102 can be formed between the second strap body 120 and the second section 113. By adjusting the connecting position between the second strap body 120 and the first strap body 110, the lengths of the first section 112 and the second section 113 can be adjusted, so that the size of the through hole 101 can be adjusted.

A first end of the pulling strip 130 is connected to the first end of the second strap body 120. A second end of the pulling strip 130 is configured to pass through the pulling channel 111 and connects to the second end of the second strap body 120. A portion of the pulling strip 130 is located within the through hole 101, while the other portion is located within the adjusting hole 102. The user's finger can extend into the adjusting hole 102 and press against the pulling strip 130 to restrict its movement relative to the pulling channel 111.

For the watch strap 100 provided by present disclosure, when the user wants to wear the watch strap 10, the user pulls the second strap body 120 to connect the second end of the second strap body 120 to the first strap body 110. When the second strap body 120 connects to the first strap body 110, the user can insert their finger into the adjusting hole 102 and press against the pulling strip 130 to limit its movement relative to the pulling channel 111. Achieving an indirectly pre-tension effect between the second strap body 120 and the pulling strip 130, preventing the pulling strip 130 from moving within the pulling channel 111. This avoids an increase in the size of the through hole 101 formed by the second strap body 120, the first section 112, and the body 200. After the second strap body 120 is connected to the first strap body 110, both the first strap body 110 and the second strap body 120 are restricted, so the effective length of the second strap body 120 and the first section 112 that form the through hole 101 cannot change. The user can then release their finger from pressing the pulling strip 130, and in this state, the size of the through hole 101 can still be maintained. This ensures that when the watch strap 100 is worn, the through hole 101 will not be stretched, effectively reducing the risk of the watch strap 100 falling off during wear, resulting in a better user experience.

As shown in FIGS. 1 and 2, a width of the pulling strip 130 is smaller than that of the second strap body 120, allowing the pulling strip 130 to fit against the side of the second strap body 120 that faces the through hole 101. The first end of the pulling strip 130 is fixed to the first end of the second strap body 120 by sewing or adhesive bonding, while the second end of the pulling strip 130 is fixed to the second end of the second strap body 120 by sewing or adhesive bonding.

The pulling strip 130 includes a first segment 131 and a second segment 132. The first segment 131 is the portion of the pulling strip 130 located between the first end of the pulling strip 130 and the pulling channel 111. The first segment 131 is located within the through hole 101. While the second segment 132 is a portion of the pulling strip 130 located between the pulling channel 111 and the second end of the pulling strip 130. The second segment 132 is located within the adjusting hole 102.

The watch strap 100 also includes a connector 140, which allows the second end of the second strap body 120 to be detachably connected to the first strap body 110. The connector 140 can be a hook-and-loop structure, a magnetic buckle structure, or an elastic buckle structure, enabling the second strap body 120 and the first strap body 110 to be quickly engaged and locked, as well as quickly separated.

As shown in FIGS. 1 and 2, in this embodiment, the connector 140 is a hook-and-loop structure. The connector 140 includes a first member 141 and a second member 142, which can be adhered together or separated from each other. The first member 141 is positioned on the first strap body 110 and extends along the length of the first strap body 110. Specifically, the first member 141 extends from the first end of the first strap body 110 to the second end of the first strap body 110. The second member 142 is positioned on the second end of the second strap body 120, allowing the second member 142 to adhere to different positions of the first member 141. This arrangement allows for the adjustment of the lengths of the first section 112 and the second section 113, thereby making the size of the through hole 101 adjustable.

Optionally, the first member 141 can be fixed to the first strap body 110 by sewing or adhesive bonding. Furthermore, the second member 142 can be fixed to the second strap body 120 by sewing or adhesive bonding. The second member 142 covers the second end of the pulling strip 130.

As shown in FIG. 1, the watch strap 100 also includes a first connector 150, which is used to connect the first end of the first strap body 110 to the body 200. Additionally, the watch strap 100 includes a second connector 160, which is used to connect the first end of the second strap body 120 to the body 200.

The first connector 150 and the second connector 160 are connected to the body 200 of the wearable device respectively. Specifically, the first connector 150 and the second connector 160 are positioned on opposite sides of the body 200, and the first connector 150 and second connector 160 can be either fixedly connected or integrally molded with the body 200. In an optional embodiment, the two sides of the body 200 are provided with a first installating slot 210 and a second installating slot 220, and the first connector 150 and second connector 160 are respectively positioned in the first installating slot 210 and second installating slot 220.

The first connector 150 has a first connecting ring 152 through which the first end of the first strap body 110 passes. The second connector 160 has a second connecting ring 162 through which the first end of the second strap body 120 passes. After the first end of the first strap body 110 passes through the first connecting ring 152, it folds back to form a loop structure. After the first end of the second strap body 120 passes through the second connecting ring 162, it folds back to form a loop structure.

As shown in FIGS. 1 and 2, at least one of the first strap body 110 and the second strap body 120 is provided with a reinforcement layer 170 to enhance the structural strength of the watch strap 100. Specifically, the reinforcement layer 170 is positioned on the side of the second strap body 120 opposite the through hole 101. The reinforcement layer 170 can be fixed to the second strap body 120 by sewing or adhesive bonding. The a of the reinforcement layer 170 is smaller than a width of the second strap body 120, and the reinforcement layer 170 extends along the length direction of the second strap body 120, from the first end of the second strap body 120 to the second end of the second strap body 120.

Figure 4:
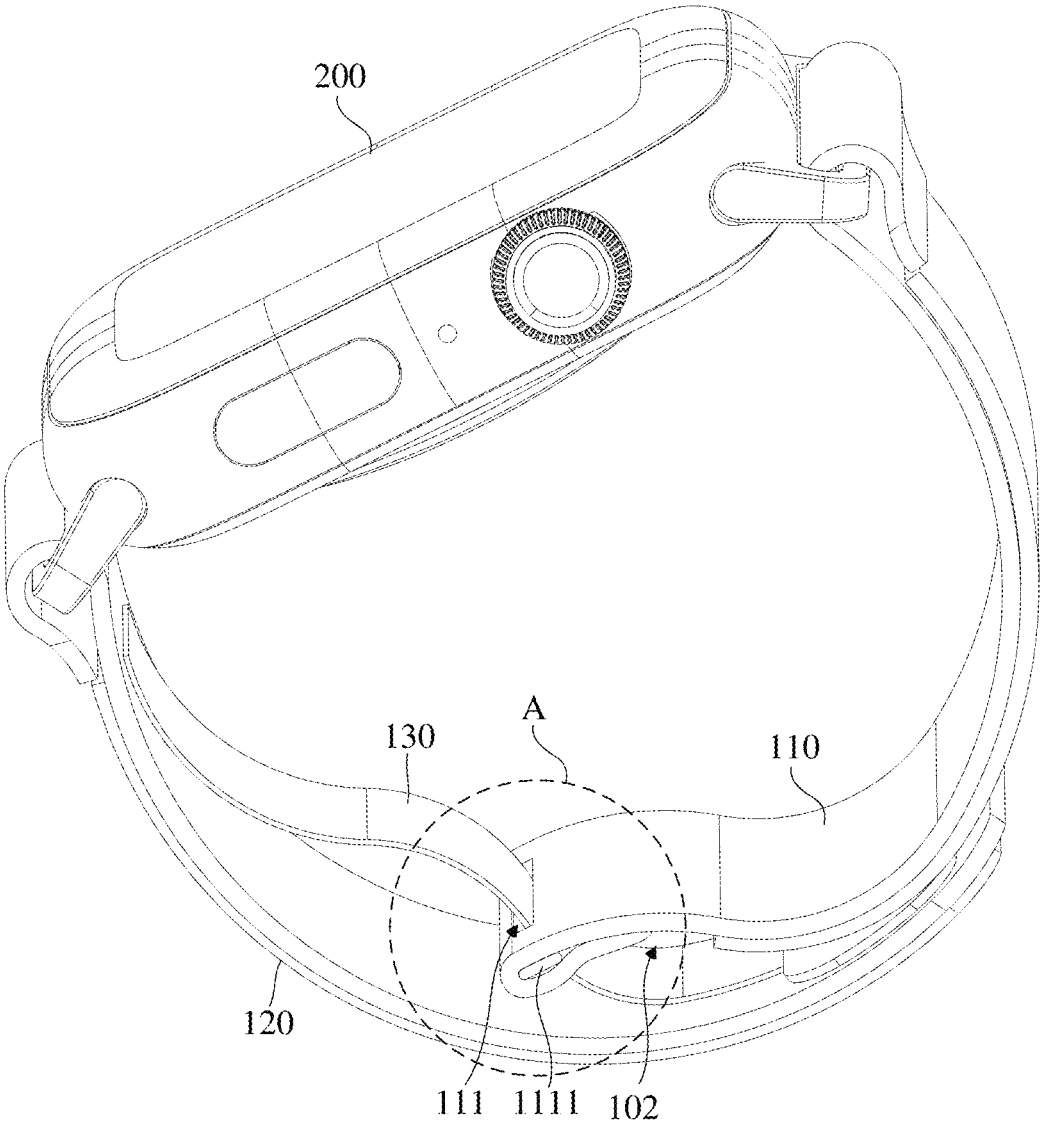
FIG. 4 is a schematic diagram showing a separating state of a first strap body and a second strap body according to an embodiment of the present disclosure.
Figure 5:
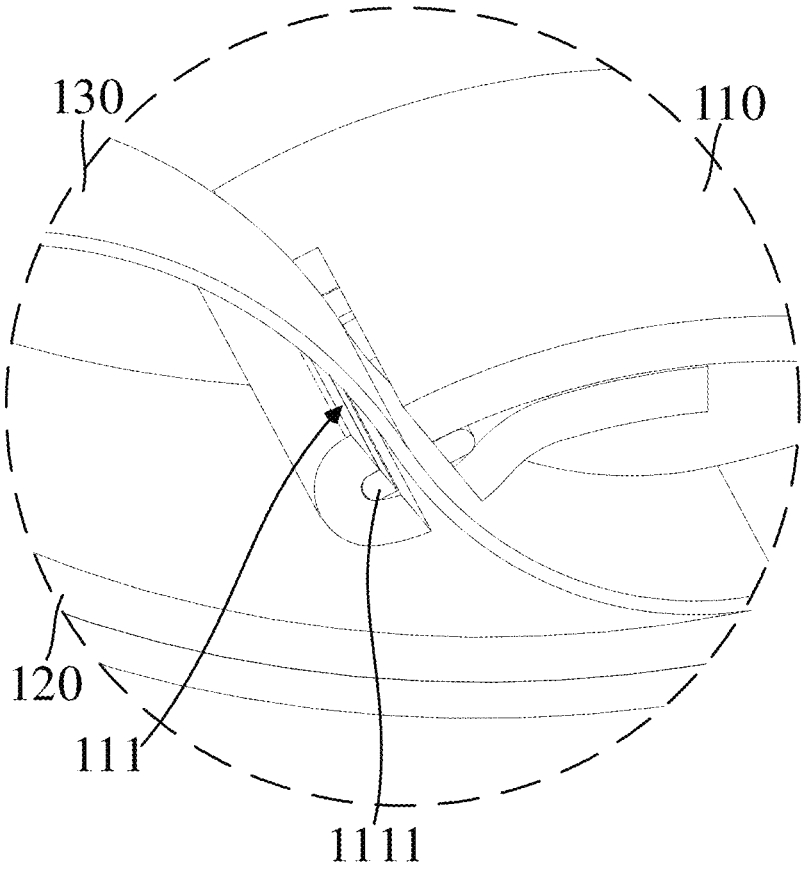
FIG. 5 is a the cross-sectional view of area A of FIG. 4.

The present disclosure also provides another embodiment, please referring to FIGS. 4 and 5, the watch strap 100 and the wearable device 10 are structurally similar to the previous embodiment, with the difference being the structure within the pulling channel 111. In this embodiment, the pulling channel 111 is provided with damping glue 1111. When the pulling strip 130 moves within the pulling channel 111, it continuously comes to contact the damping glue 1111. The damping glue 1111 can be a nylon-based glue with a high friction damping coefficient. Specifically, damping glue 1111 can be applied to the inner wall of the pulling channel 111 to form the damping glue 1111. Of course, the damping glue 1111 can also be pre-formed into a damping rubber ring. After the second end of the first strap body 110 folds back, the damping rubber ring is wrapped and fixed, and the pulling strip 130 is threaded through the pulling channel 111 and the damping rubber ring. When the pulling strip 130 is pulled, it can contact with the inner wall of the damping rubber ring.

In summary, since this embodiment adopts the damping glue 1111 within the pulling channel 111, the damping of the pulling strip 130 within the pulling channel 111 can be increased during use, reducing the finger resistance on the pulling strip 130, making it easier for the user to wear. It is also worth noting that when the damping glue provides sufficient damping to the movement of the pulling strip 130, there may be no need for the user to apply finger pressure to hold the pulling strip 130 while wearing the watch strap 100.

The above descriptions are only preferred embodiments of the present application and do not limit the patent scope of the present application. Any equivalent structural modifications or direct/indirect applications in other related technical fields based on the application's concept described in the specification and accompanying drawings are included within the scope of this application.

What is claimed is:

1. A watch strap, comprising a first strap body, a second strap body and a pulling strip;

wherein a first end of the first strap body is configured to connect with a body of a wearable device, and a second end of the first strap body is defined with a pulling channel; and a first end of the second strap body is configured to connect with the body of the wearable device, and a second end of the second strap body is detachably connected to the first strap body;

wherein the first strap body comprises a first section and a second section;

the first section is between the body of the wearable device and a connecting position of the first strap body and the second strap body; and the second strap body, the first section, and the body of the wearable device are jointly enclosed to form a through hole;

lengths of the first section and second section are adjusted by changing the connecting position between the second strap body and the first strap body, thereby adjusting a size of the through hole;

wherein a first end of the pulling strip is connected to the first end of the second strap body, and a second end of the pulling strip is configured to pass through the pulling channel and connect with the second end of the second strap body; and a portion of the pulling strip is located inside the through hole.

2. The watch strap according to claim 1, wherein a width of the pulling strip is smaller than a width of the second strap body, and the pulling strip is fitted on one side of the second strap body facing the through hole.

3. The watch strap according to claim 1, wherein the first end of the pulling strip is fixed to the first end of the second strap body by sewing or adhesive bonding, and/or the second end of the pulling strip is fixed to the second end of the second strap body by sewing or adhesive bonding.

4. The watch strap according to claim 1, wherein the pulling strip comprises a first segment and a second segment connected together, wherein the first segment is a portion of the pulling strip between the first end of the pulling strip and the pulling channel, and is located inside the through hole.

5. The watch strap according to claim 1, wherein the watch strap further comprises a connector, the connector is configured to detachably connect the second end of the second strap body to the first strap body.

6. The watch strap according to claim 5, wherein the connector is a hook-and-loop structure, the connector comprises a first member and second member;

wherein the first member is arranged on the first strap body, extending along a length direction of the first strap body;

and the second member is arranged at the second end of the second strap body, allowing the second member to engage with the first member at different positions, thus adjusting the lengths of the first section and second section and the size of the through hole.

7. The watch strap according to claim 1, wherein the watch strap further comprises a first connector and a second connector, wherein the first connector is configured to connect the first end of the first strap body and the body of the wearable device, and the second connector is configured to connect the first end of the second strap body and the body of the wearable device.

8. The watch strap according to claim 1, wherein at least one of the first strap body or the second strap body is provided with a reinforcement layer.

9. A wearable device, comprising a body of the wearable device and a watch strap;

wherein, the watch strap comprises a first strap body, a second strap body and a pulling strip;

wherein a first end of the first strap body is configured to connect with a body of a wearable device, and a second end of the first strap body is defined with a pulling channel; and a first end of the second strap body is configured to connect with the body of the wearable device, and a second end of the second strap body is detachably connected to the first strap body;

wherein, the first strap body comprises a first section and a second section;

the first section is between the body of the wearable device and a connecting position of the first strap body and the second strap body; and the second strap body, the first section, and the body of the wearable device are jointly enclosed to form a through hole;

lengths of the first section and second section are adjusted by changing the connecting position between the second strap body and the first strap body, thereby adjusting a size of the through hole;

wherein a first end of the pulling strip is connected to the first end of the second strap body, and a second end of the pulling strip is configured to pass through the pulling channel and connect with the second end of the second strap body; and a portion of the pulling strip is located inside the through hole.

* * * * *